US009556624B1

(12) United States Patent
Law

(10) Patent No.: US 9,556,624 B1
(45) Date of Patent: Jan. 31, 2017

(54) SCAFFOLD SYSTEM

(71) Applicant: Utility Service Co., Inc., Atlanta, GA (US)

(72) Inventor: Pierce Law, Camillus, NY (US)

(73) Assignee: Utility Service Co., Inc., Atlanta, GA (US)

( * ) Notice: Subject to any disclaimer, the term of this patent is extended or adjusted under 35 U.S.C. 154(b) by 0 days.

(21) Appl. No.: 14/751,915

(22) Filed: Jun. 26, 2015

Related U.S. Application Data

(60) Provisional application No. 62/017,872, filed on Jun. 27, 2014.

(51) Int. Cl.

| | |
|---|---|
| ***E04G 1/04*** | (2006.01) |
| ***E04G 1/14*** | (2006.01) |
| ***E04G 3/24*** | (2006.01) |
| ***E04G 1/15*** | (2006.01) |
| ***E04G 1/20*** | (2006.01) |

(52) U.S. Cl.
CPC . *E04G 1/04* (2013.01); *E04G 1/14* (2013.01); *E04G 1/15* (2013.01); *E04G 1/20* (2013.01); *E04G 3/243* (2013.01)

(58) Field of Classification Search
CPC ..... E04G 1/14; E04G 1/15; E04G 1/20; E04G 3/24; E04G 3/243; E04G 5/02; E04G 5/025; E04G 5/14; E04G 5/142
See application file for complete search history.

(56) References Cited

U.S. PATENT DOCUMENTS

| | | | | | |
|---|---|---|---|---|---|
| 3,084,761 | A * | 4/1963 | Robertson | E04G 1/14 | 182/178.6 |
| 3,313,081 | A * | 4/1967 | Squire | D01H 5/60 | 182/178.5 |
| 3,782,048 | A | 1/1974 | Corman | | |
| 3,791,486 | A | 2/1974 | Marnoch | | |
| 4,430,839 | A | 2/1984 | Butters | | |
| 4,782,914 | A * | 11/1988 | Nail | E04G 5/14 | 182/113 |
| 4,830,144 | A * | 5/1989 | Werner | E04G 1/14 | 182/119 |
| 4,891,926 | A | 1/1990 | Allenbaugh | | |

(Continued)

FOREIGN PATENT DOCUMENTS

| | | | | |
|---|---|---|---|---|
| DE | 3611431 A1 * | 10/1987 | ..... | E04G 1/14 |
| DE | 10128002 C1 * | 5/2003 | ..... | E04G 1/15 |
| EP | 2407610 A2 | 7/2011 | | |

*Primary Examiner* — Colleen M Chavchavadze
(74) *Attorney, Agent, or Firm* — David Sudderth

(57) ABSTRACT

A scaffold system for supporting workers includes a plurality of end frames including a pair of uprights joined by an overhead cross bar for supporting planks thereon. The end frames are stacked top-to-bottom to form end frame columns and are laterally secured together to form an exterior framework. The scaffold system also includes interior posts coupled vertically end-to-end so as to form interior columns, with pairs of interior columns being secured to each end frame column between the vertical uprights of the end frames. Side rails are mounted to the interior posts extending between the pairs of interior posts. Planks are supported on the overhead cross bars, extending between adjacent end frames, and are bounded at their ends by the pairs of interior posts to form a work space and/or walkway for workers of a reduced size or area.

11 Claims, 4 Drawing Sheets

(56) References Cited

U.S. PATENT DOCUMENTS

| | | | | |
|---|---|---|---|---|
| 4,979,589 | A | 12/1990 | Sugiyama et al. | |
| 5,127,492 | A * | 7/1992 | Preston | E04G 1/14 182/152 |
| 5,145,030 | A * | 9/1992 | Pavlescak | E04G 5/14 182/113 |
| 5,159,993 | A | 11/1992 | St-Germain | |
| 5,592,789 | A | 1/1997 | Liddell et al. | |
| 6,185,887 | B1 | 2/2001 | Strassle | |
| 6,397,551 | B1 | 6/2002 | Lewcock et al. | |
| 6,554,102 | B2 * | 4/2003 | Schworer | E04G 5/147 182/178.5 |
| 6,904,720 | B1 | 6/2005 | Adolfson et al. | |
| 6,969,211 | B2 | 11/2005 | Altman | |
| 7,004,667 | B2 | 2/2006 | Ludwig et al. | |
| 7,096,637 | B2 | 8/2006 | McMillan | |
| 7,114,296 | B2 | 10/2006 | Klassen et al. | |
| 7,260,919 | B1 | 8/2007 | Spransy et al. | |
| 7,578,111 | B2 | 8/2009 | Hawes | |
| 7,661,271 | B1 | 2/2010 | Millsaps, Jr. | |
| 8,008,822 | B2 | 8/2011 | Hopewell et al. | |
| 8,375,695 | B2 | 2/2013 | Schilling et al. | |
| 8,931,594 | B2 * | 1/2015 | Kreller | E04G 1/14 182/113 |
| 2002/0059774 | A1 | 5/2002 | Collins | |
| 2008/0202043 | A1 | 8/2008 | Marshall et al. | |
| 2009/0178885 | A1 * | 7/2009 | Heath | E04G 1/14 182/119 |
| 2010/0037538 | A1 | 2/2010 | Sorich | |
| 2010/0122872 | A1 * | 5/2010 | Korevaar | E04G 1/20 182/113 |
| 2013/0043095 | A1 * | 2/2013 | Thacker | E04G 1/14 182/186.7 |

* cited by examiner

SCAFFOLD SYSTEM

CROSS REFERENCE TO RELATED APPLICATIONS

The present Patent Application is a formalization of previously filed, U.S. Provisional Patent Application Ser. No. 62/017,872, filed Jun. 27, 2014 by the inventor named in the present Application. This Patent Application claims the benefit of the filing date of this cited Provisional Patent Application according to the statutes and rules governing provisional patent applications, particularly 35 U.S.C. §119 (e), and 37 C.F.R. §§1.78(a)(3) and 1.78(a)(4). The specification and drawings of the Provisional Patent Application referenced above are specifically incorporated by reference herein as if set forth in their entirety.

FIELD OF THE INVENTION

The present application generally relates to scaffolding for supporting workers, equipment and materials adjacent to elevated structures.

BACKGROUND

During the construction or maintenance of elevated structures such as buildings, bridges, walkways, towers, monuments, and the like, temporary scaffold systems are often erected around the perimeter of the structure to support the workers engaged in construction or maintenance activities. These scaffold systems are also typically configured and/or covered to control or inhibit the falling of debris onto other workers or passersby, for example, being enclosed within a protective or containment barrier, generally comprised of flexible plastic sheeting that surrounds both the structure and the scaffold system. Such barriers generally are required to contain or prevent any harmful chemicals or nuisance products of construction from escaping into the surrounding environment.

As illustrated in FIG. 1A, one common application for a scaffold system 20 installed around an elevated structure 10 and which requires an outer containment barrier 50 is the periodic sand blasting and re-painting of structures, such as a water tower 12 for maintenance purposes. Water towers and other, similar structures generally have cylindrical or substantially non-planar shapes, and thus the scaffold system typically must be installed in a curved arrangement to provide walkways that substantially conform to the rounded perimeter of the tower 12. The curved scaffold system 20 will generally comprise a plurality of end frames 32 that are stacked top-to-bottom, and will be connected laterally to one another with cross-bracing (not shown) with walk-through openings defined therebetween, to form the scaffold framework 24. Planking 40, typically comprising sets of side-by-side planks 42, is placed on cross bars 36 extending along the tops of the end frames 32, spanning the spaces between the end frames, often in alternating overlapping fashion between segments of the scaffold framework 24, so that workers can move along the walkways formed thereby to conduct their activities. Federal Safety Regulations require the planking be "complete" between the outer posts of the end frames, with no gaps therebetween. The outer containment barrier 50 formed from flexible sheeting 52 is then attached or shrink-wrapped around the outer perimeter of the scaffold framework 24 to seal both the elevated structure 10 and the scaffold framework, including the planking 40, within the volume defined by the outer sidewall of the water tower 12 and the inside surface of the containment barrier 50.

However, even as the arrangement of end frame columns 30 within the scaffold system 20 is curved to follow the contours of the water tower 12, the rectangular shape of the planks 42 of the planking 40 structure, and the requirement that all of the planks 42 be fully supported by cross bars 36 at both ends, does not lend itself to a smooth cylindrical contour. As a result, where curved scaffold systems 20 are used, this often results in the corners 44 of the outermost planks projecting outwardly beyond the outermost uprights 34 of the end frames 32, as shown in FIG. 1B. Since the flexible sheeting 52 must be pulled tight against the scaffold system structure to ensure proper containment, the corners 44 can create stress points 56 at the joints about the curved structure. Over time, wind and other elemental forces and localized motions of the scaffold system 20 caused by the workers moving therealong, can initiate tearing in the sheeting 52 at the stress points 56, creating holes in the containment barrier 50 that, if left uncorrected would allow chemicals or nuisance products of construction to escape into the surrounding environment. Such breaches of containment are impermissible per applicable environmental and safety regulations, the damage to the sheeting 52, and thus may require premature replacement of one or more sections of the containment barrier 50.

Consequently, a need exists for a scaffold system that provides for an efficient and low cost structure that meets regulatory requirements for safety and support when erected next to non-planar elevated structures while maintaining the integrity of the containment barrier. It is toward such a scaffold system that the present disclosure is directed.

SUMMARY

Briefly described, embodiments of the present application are directed to a scaffold system for supporting workers adjacent an elevated structure, and which includes a plurality of walk-through end frames, each end frame generally comprising two uprights joined by an overhead cross bar for supporting a series of planks thereon. In one embodiment, the end frames are stacked top-to-bottom to form end frame columns that in turn can be laterally secured together with bracing to form a vertical framework that can be located/erected about or adjacent the elevated structure. The scaffold system can be provided as part of a new scaffold frame structure or as a retro-fit system to existing scaffold systems/structures, and will include a plurality of vertical rails or posts coupled in a stacked, vertically extending arrangement or configuration, and secured to the end posts to form a series of interior column support structures.

A pair of interior column support structures can be secured to each end frame column, generally located at substantially centralized positions between the vertical uprights of the end frames. Sets of side rails further can be coupled between corresponding ones of the vertical posts of the interior columns secured to end frame columns. Sets of planks thereafter can be supported on the overhead cross bars at the end frames, extending between adjacent end frame columns and being bounded by the interior columns. The resultant structure forms a supplemental interior framework within the overall exterior scaffolding framework, forming a work space and/or walkway for workers having a width that is substantially less than the total width of the end frames but which provides for complete planking therebetween.

To assemble the scaffold system for supporting workers adjacent or about an elevated structure, a plurality of end frames may be top-to-bottom to form a plurality of end frame columns. Each of the walk-through end frames further generally may be coupled with bracing to form an exterior framework adjacent to and/or surrounding an elevated structure, which exterior framework also can be secured to the elevated structure. The method of assembly further can include coupling a plurality of vertical rails or interior posts vertically end-to-end to form pairs of interior columns which may be attached or clamped to each end frame column between the vertical uprights of the end frames of such end frame columns. The method also may include coupling a plurality of side rails between the posts secured to adjacent end frame columns to form an interior framework within the exterior scaffold framework. A plurality of planks can be placed/mounted onto the overhead cross bars of the end frames, with the planks extending longitudinally between adjacent end frames of the end frame columns, and with the planks being bounded at the lateral sides thereof by the pair of interior columns so as to form a workspace and/or walkway for workers having a width that is less than the width of the end frames.

The invention will be better understood upon review of the detailed description set forth below taken in conjunction with the accompanying drawing figures, which are briefly described as follows.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present disclosure described herein.

DETAILED DESCRIPTION

The present disclosure relates generally to a scaffold system for supporting workers, equipment and materials adjacent to an elevated structure, and particularly to a scaffold system that provides walkways around a non-planar or curved elevated structure, such as a water tower or other structure or building. The scaffold system can be used as a retro-fit for existing scaffold systems or part of a new construction scaffold system and is designed to meet industrial and regulatory requirements for safety and support when erected around the non-planar elevated structures, while at the same time maintaining the integrity of a containment barrier disposed around its outer perimeter. The disclosure also includes one or more methods for assembling or erecting the scaffold system. As described in more detail below, the scaffold system can provide several significant advantages and benefits over other types of scaffolding and methods for assembly or erecting scaffolding. It is noted, however, that the recited advantages are not meant to be limiting in any way, as one skilled in the art will appreciate that other advantages may also be realized upon practicing the present disclosure.

Figure 1A:
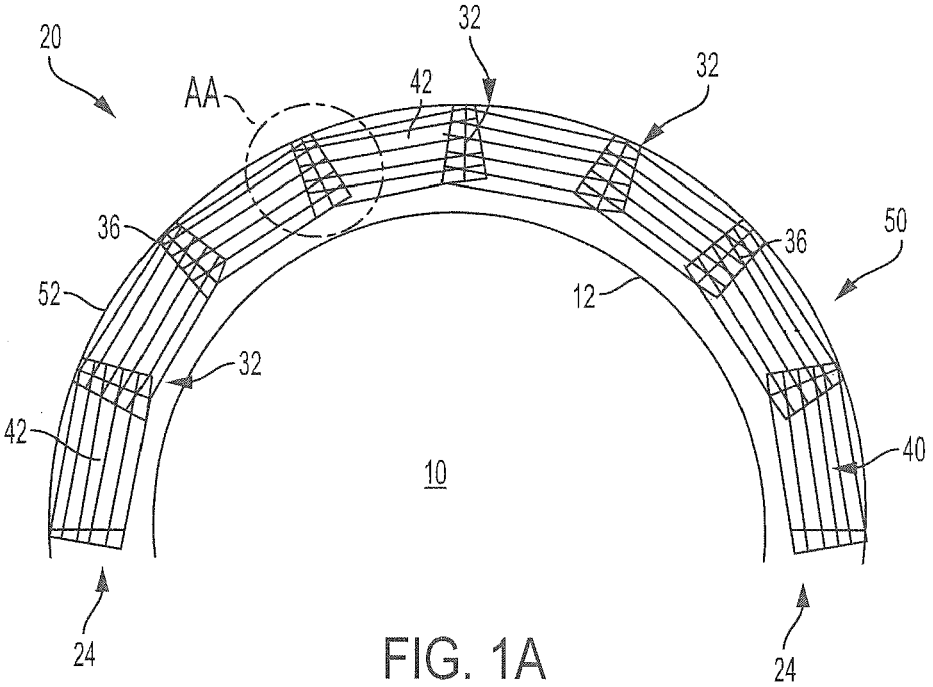
FIG. 1A PRIOR ART
FIG. 1A is a schematic plan view of a prior art scaffold system assembled around a non-planar elevated structure.
Figure 1B:
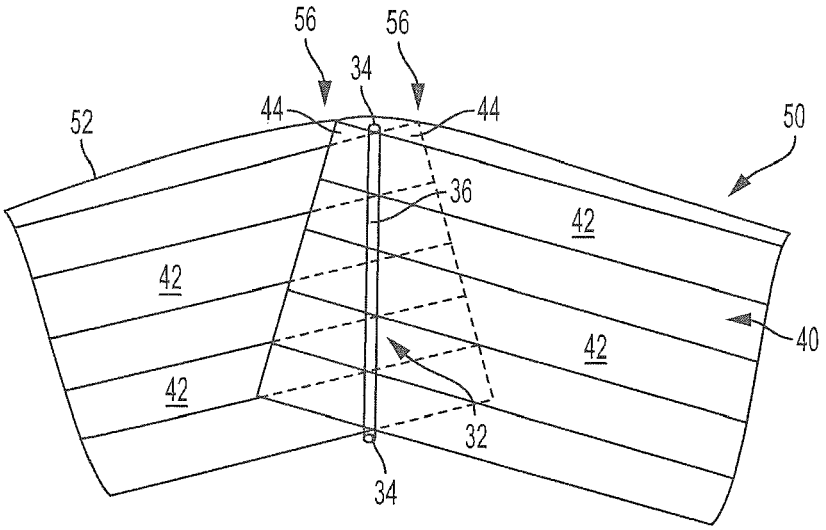
FIG. 1B PRIOR ART
FIG. 1B is a close up view of the prior art scaffold system of FIG. 1A, as viewed from Section Line A-A.
Figure 2:
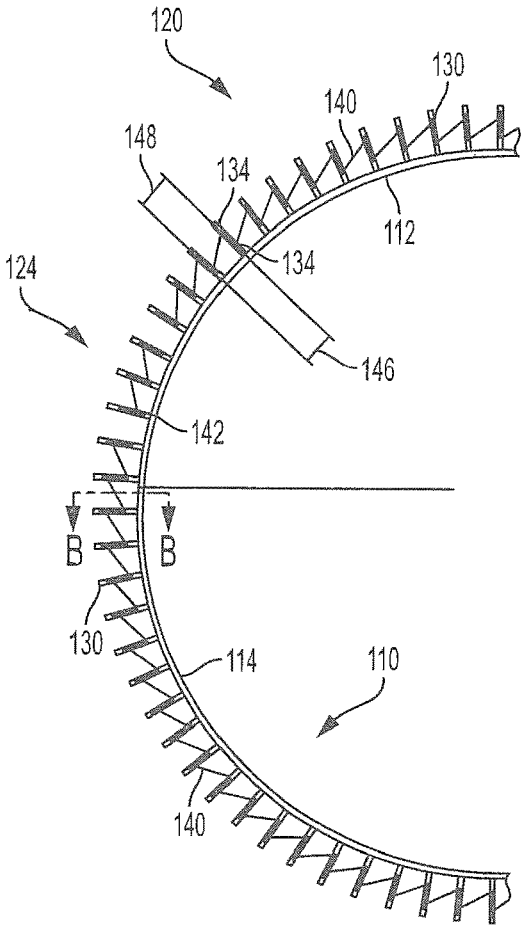
FIG. 2 is a schematic plan view of a scaffold system that has been partially assembled around a non-planar elevated structure, in accordance with one representative embodiment of the present disclosure.
Figure 3:
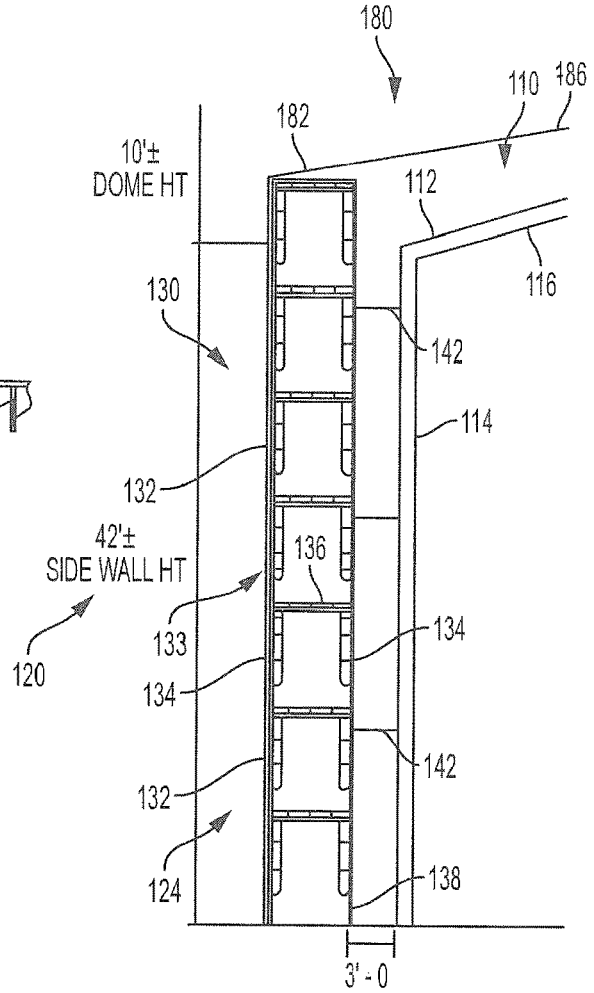
FIG. 3 is cross-sectional side view of the partially-assembled scaffold system of FIG. 2, as viewed from Section Line B-B.

Referring now in more detail to the drawing figures, wherein like parts are identified with like reference numerals throughout the several views, FIGS. 2-3 illustrate a partially assembled scaffold system 120 erected around a non-planar elevated structure 110, in accordance with one representative embodiment of the present disclosure. As depicted in the illustrated example, the elevated structure 110 can comprise a structure 112 having substantially cylindrical side walls 114 and a sloped or peaked roof 116 (for example, a water tower). However, it is to be appreciated that the scaffold system of the present disclosure has application with a wide variety of elevated structures, including buildings, bridges, walkways, towers, monuments, and the like. In addition, the scaffold system 120 can be erected and secured about and/or against elevated structures and can have non-planar surfaces or walls, substantially planar surfaces or walls, or both. The scaffold system thus can be arranged in various configurations, including non-planar configurations that can substantially match a configuration of the adjacent structure and/or the walls or other portions thereof.

The scaffold system 120 generally includes an external or exterior framework 124 formed by a plurality of spaced end frame columns 130, each of which will be formed from a series of stacked end frames 132 that are laterally secured together with support bars or braces, such as cross bracing 140 so as to form scaffold units or modules 133. Each of their end frames 132 of the scaffold units further will be stacked top-to-bottom until they reach the desired height for the end frame column 130. Each end frame 132 can include a pair of spaced uprights 134 joined by at least one overhead cross bar 136 configured for supporting planks thereon. In one aspect, the end frames 132 can be conventional scaffold end frames that can be connected or coupled together in spaced series with cross-braces 140 to define scaffold units 133 of a walk-through scaffold structure or assembly 135, which, as known to one of skill in the art, are sized to allow a worker to walk between the end frames 132. In addition, in one aspect, the width of each end frame 132, as measured along the overhead cross bars 136, can be substantially equivalent to the width of five standard-use solid wood planks, or about five feet. It is to be appreciated, however, that end frames having different widths are also possible. In other aspects, each end frame 132 can include two or more cross bars 136, which can be vertically spaced from each other to allow planks 172 to be inserted between the cross bars so that each planking segment is support directly on a cross bar, rather than having the ends 173 of alternate planking segments 172 overlapping and resting on the planking of their adjacent segments, as illustrated in FIG.

1B. Other features such as ladder rungs, footholds, locking members and adjustable support feet, as understood in the art, also can be used.

The exterior frame 124 of the scaffold system 120, once erected, can be secured to the elevated structure 110 or water tank 112, such as with ties 142, straps or other connectors, that can extend from each of the end frame columns 130 to the sidewall 114 of the water tank. In one aspect, the ties can extend from every-other course or level of end frames 132 to the sidewall 114. In addition, as indicated in FIG. 2, the curved shape of the exterior frame 124 of the scaffold system 120 can cause the longitudinal distances or spacing 146 between each of the end frames of the columns 130, as measured between the innermost uprights 134 of the end frames adjacent the elevated structure 110, to be different than the longitudinal distances or spacings 148 measured between the outer uprights 134 that are opposite the elevated structure 110. For instance, in one example, the average distance or spacing 146 between the inner uprights in each segment or bay can be about six feet, while the average distance or spacing 148 between the outer uprights may be significantly larger (e.g., about seven feet).

Figure 4:
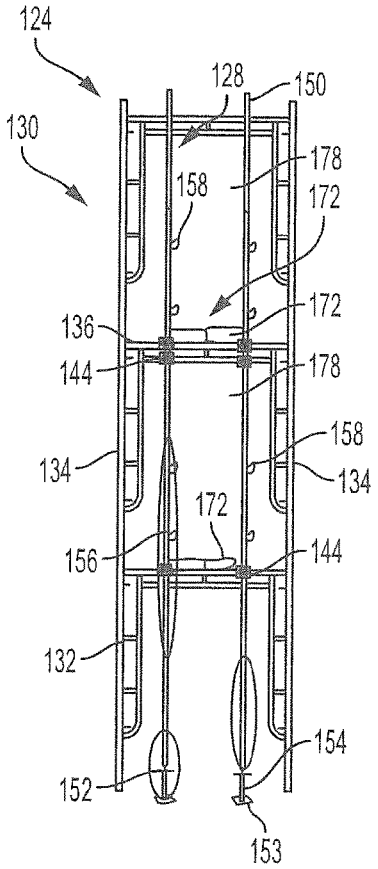
FIG. 4 is schematic cross-sectional view of the scaffold system of FIG. 2 that includes the internal framework and planking.
Figure 5:
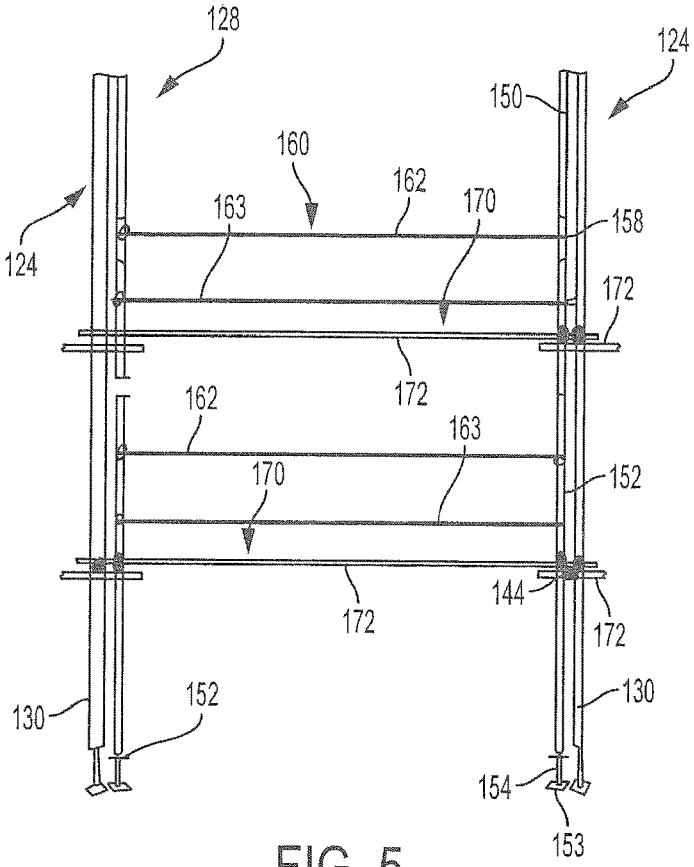
FIG. 5 is schematic side view of the scaffold system of FIG. 2 that includes the internal framework and planking.
Figure 6:
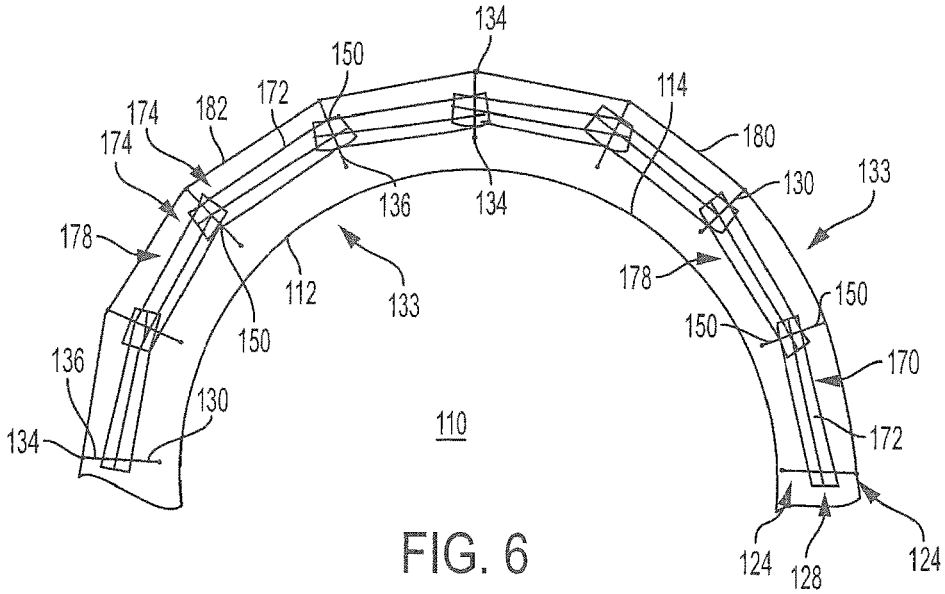
FIG. 6 is a schematic plan view of the scaffold system of FIG. 2 that includes the internal framework and planking.

With reference to FIGS. 4-6, the scaffold system 120 also includes a plurality of vertical rails or posts 156 that can be coupled together end-to-end, in a vertically extending arrangement to form a plurality of interior columns 150 adjacent each end frame column. A pair of interior columns 150 will be secured to each end frame column 130 generally approximately centrally located between the vertical uprights 134 of the end frames 132 of end frame column 130. In one aspect, the posts 156 can be coupled to the cross bars 136 of the end frames 132 with swivel clamps 144 (such as the swivel clamp 144 shown in FIG. 8) that allow for the two elongated tubular members to be coupled together in a substantially orthogonal relationship. For instance, as shown in the illustrated embodiment, the vertically-extending posts 156 will be coupled to the horizontally-extending cross bars 136 by the swivel clamps. It is to be appreciated, however, that other mechanisms or devices for securing the interior columns 150 between the vertical uprights 134 of the end frames 132 in an end frame column 130 are also possible and considered to fall within the scope of the present disclosure.

As also shown in FIGS. 4-5, the lower ends 151 of each of the interior columns 150 further generally will include screw jacks 152 and threaded rods or starter posts 154, including support plates or feet 153 mounted thereto, for adjustably supporting the interior columns 150 on the ground surface. As a result, even though the pairs of interior columns 150 are coupled to the end frame columns 130, the interior columns 150 generally can be self-supporting and able to bear their own weight. Thus, in one aspect described in more detail below, the interior columns 150 do not substantially add to the weight load carried by the end frame columns 130, and instead can operate to help maintain or potentially spread or reduce the loads placed on the end frame columns. However, it is to be appreciated that in other aspects the interior columns 150 may not include screw jacks 152 and rods or posts 154, and instead may be both coupled to and carried by the end frames 132 that form the end frame columns 130. In addition, the screw jacks enable the adjustment of the posts vertically as needed.

Figure 7:
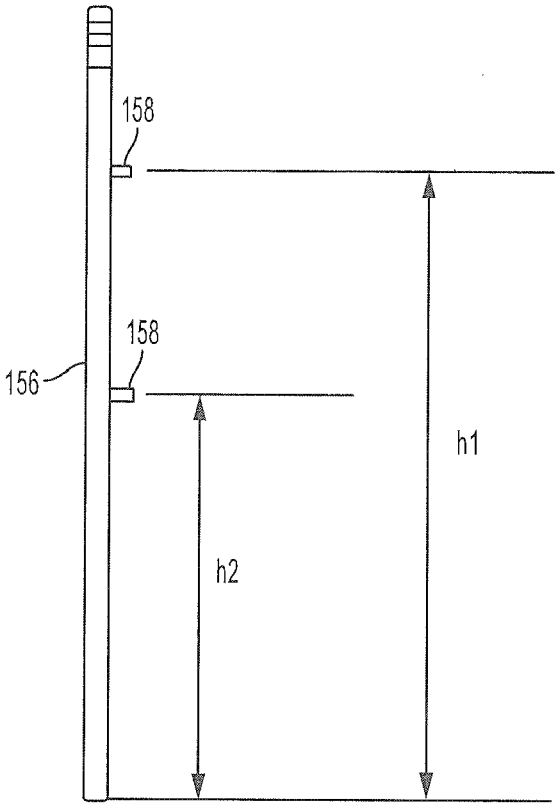
FIG. 7 is a side view of a vertical rail or interior post of the scaffold system of FIG. 2 in isolation.
Figure 8:
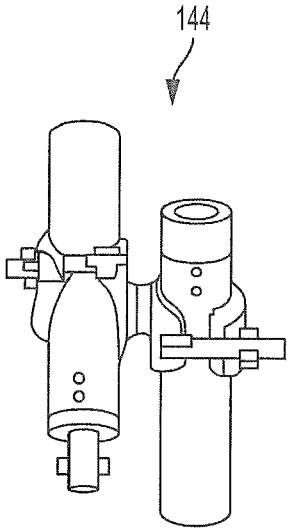
FIG. 8 is a side view of a swivel clamp of the scaffold system of FIG. 2 in isolation.
Figure 9:
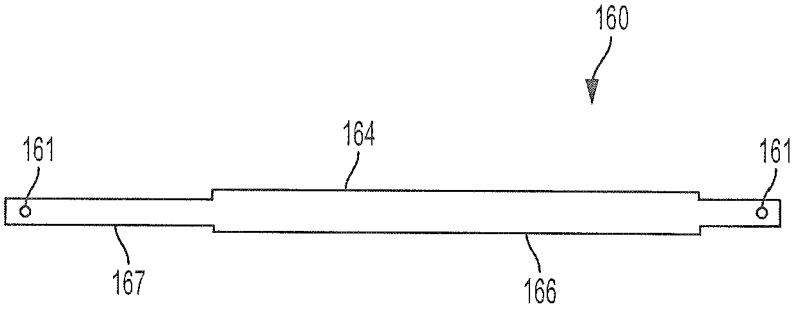
FIG. 9 is a side view of a telescoping guard rail of the scaffold system of FIG. 2 in isolation.

Each of the posts 156 that form the interior columns 150 generally includes one or more rail attachment mechanisms 158, such as D-locks or G-locks, that allow one or more guard rails or side rails 160 to be attached directly to the posts 156 of the interior columns 150, rather than to the end frames 134 of the end frame columns 130. For example, the D-locks can be mounted at desired elevations along the posts 156 and can include pivoting latches that engage a latch opening 161 in one of the ends of a side rail 160, as indicated in FIGS. 5, 7 and 9. As a result, as shown in FIGS. 4-5, the horizontal rails 160 are secured at desired or required heights along their posts 156 of the vertical interior columns 150 act as guard rails, and to connect the posts 156 of the interior columns 150 in a manner, so as to form an interior framework 128 contained within the exterior scaffolding framework 124, with the two frameworks generally being connected together by the swivel clamps 144 (FIG. 8).

In embodiments in which the interior columns 150 are self-supported from the screw jacks 152 and threaded rods or starter posts 154, the posts 156 will be adjusted via the screw jacks to locate the attachment mechanisms for the rails, and thus the rails when attached thereby, at a desired, or required, elevation. In addition, the weight of the side rails 160 can be substantially transferred away from the exterior framework 124 and carried by the interior framework 128, with the exterior framework providing enhances rigidity and support thereto. In embodiments in which the interior columns 150 are not self-supporting, the weight of the side rails 160 can generally remain with the exterior framework 124, along with the additional weight of the interior columns 150.

As shown in FIGS. 5 and 7, the side rails 160 can further comprise a top rail 162 and a mid rail 163. The top rail 162 can be secured at either end to a posts 156 with a rail attachment mechanism 158 located at a distance h1 from the bottom of the post 152, while the mid rail 163 can be secured to the post 130 with a rail attachment mechanism 158 located at a distance h2 from the bottom of the post 150. In one aspect, as indicated in FIG. 4, the ends of the posts 156 can be purposefully configured not to coincide with the joints between end frames 132, so that a solid portion of the post 156 is available for securing within the swivel clamp 144. As such, the elevation of the post 150 relative to the elevation of the planking 170 may be carefully controlled by the screw jacks to ensure that the guard rails 160 are located at the proscribed distance above the top surface of the planks 172.

In addition, because the distance or spacing between the end frame columns 130 (FIGS. 4-5) can vary from the inner uprights 134 adjacent the elevated structure 112 and the outer uprights 134 that are opposite the elevated structure 112, the distance or spacing between interior columns 150 coupled to those end frame columns 130 can also vary. Consequently, the length of the rails 160 can often be irregular, whether greater or less than the standard lengths of rails generally available in the art. Thus, in some embodiments the length of the rails 160 can be adjustable, such as with the adjustable rail 164 shown in FIG. 9 in which an inner or first rail or segment 167 is telescopically mounted within an outer or second rail or segment 166, with the latch openings/apertures 161 formed in either end being connectable to the rail attachment mechanisms 158 located on the posts 156 as indicated in FIGS. 5 and 7.

Also shown in FIGS. 4-6, the scaffold system 120 further includes planking 170 extending between adjacent end frame columns 130 and being supported on the overhead cross bars 136 of the end frames 130 at each level. Instead of being bounded or limited by the vertical uprights 134 of the end frames 132, however, the planks 172 are bounded by the internal columns 150 that define a walkway width or work space area that is less than the width of the end frames 130. In the illustrated embodiment, the walkway width between the interior columns 150 is substantially less than the width of the end frames, and can be approximately equal to the width of two planks 172, although other reduced widths (e.g. widths approximately equal as one board, three boards, four boards, as well as fractional board widths) are also possible and considered to fall within the scope of the present disclosure.

With the pairs of interior columns 150 (FIGS. 4-6) being located between the vertical uprights of the end frames, and with the side rails 160 being supported by the vertical columns 150 and the planking 170 being restricted by the vertically extending interior columns 150 of the interior framework after placement on the cross bars 136. The interior columns 150 secured to the end frame columns 130, the side rails 160 and the planks 172 extending between the end frame columns 130 thus define an integral work space and/or walkway 178 for workers of a reduced area (FIG. 6) that is contained within a volume or space/perimeter area defined by the exterior framework. In embodiments where the number and height of the side rails 160 above and adjacent to the planking 170 meets the requirements for safety and support, the scaffold system 120 with the internal walkway 178 can be in compliance with both local and national industrial safety standards, including but not limited to the OSHA standards for scaffolding.

FIG. 6 is a schematic plan view of the scaffold system 120 that illustrates each of the external framework 124, the internal framework 128, and the planking 170 that extends across the gaps between adjacent end frame columns 130. Because the width of the walkway 178 defined by the planking 170 and guard rails is less than the width of external frame 124 at all points within the scaffold system 120, the walkway 178 can remain within the volume circumscribed by the external framework 124, including the outer corners 174 of the planks 172. Thus, instead of projecting beyond the vertical uprights 134 of the end frames 132, the outer corners 174 merely project beyond the outer interior column 150 opposite the enclosed structure 110 and remain within the volume or perimeter area defined by the exterior framework, so as to be well-spaced from the outer boundary of the exterior framework 124 as defined by the outer vertical uprights 134 of the end frame columns. This removes the stress points in the flexible sheeting 182 that could otherwise tear the flexible sheeting and breach the containment barrier 180, and thereby helps to maintain the integrity of the containment barrier 180.

As shown in FIG. 3, the scaffold system 120 can further include a containment barrier 180 that substantially surrounds both the exterior framework 124 and the elevated structure 110. The containment barrier 180 can comprise one or more sheets of a flexible cover or barrier material 182 secured to the outside of the exterior framework 124 and opposite to the elevated structure 110. For example, the flexible material can comprise an impermeable plastic shrink wrap or other cover or barrier material having a thickness of about 0.010-0.025 inches, although greater or lesser thicknesses also can be used for varying applications. The flexible sheets 182 also can be suspended, such as by wire ropes 186 or similar supports extending over the top of the elevated structure 110, so that the containment barrier 180 substantially completely seals the volume between the sidewalls 114 and roof 116 of the water tower 112 and the interior surface of the flexible sheets 182, so as to contain or prevent any harmful chemicals or nuisance products of construction from escaping into the surrounding environment.

As may be appreciated by one of skill in the art, the disclosed scaffold system can be further advantageous over prior art scaffolding systems through the reduction in the weight of the planking that comes from reducing the width of the walkway from five planks to less than five planks, such as, for example, two planks. This can be in addition to the redistribution of weight from the external framework to the internal framework in configurations where the internal framework is self-supporting. In some aspects the reduction in weight can be advantageous by raising the overall height limit of the scaffold system.

The foregoing description generally illustrates and describes various embodiments of the scaffold system of the present disclosure. It will, however, be understood by those skilled in the art that various changes and modifications can be made to the above-discussed scaffold system without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the scaffold system as discussed herein may be selectively interchanged and applied to other illustrated and non-illustrated embodiments of the invention, and numerous variations, modifications, and additions further can be made thereto without departing from the spirit and scope of the present invention as set forth in the appended claims.

The invention claimed is:

1. A scaffold system for supporting workers adjacent a structure, comprising:

an exterior framework comprising a plurality of end frames secured together in spaced series, each end frame including spaced uprights with at least one cross bar extending therebetween, wherein the end frames are configured to be mountable in a vertically stacked assembly to define a series of end frame columns arrangeable about the structure;

an interior framework comprising a series of interior columns mounted to the end frame columns, each interior column including a pair of posts mounted at spaced locations between the uprights of the end frames of each end frame column, and a series of adjustable side rails extendable between the posts of adjacent interior columns and releasably secured thereto at prescribed heights to form the interior framework within the exterior framework;

wherein each interior column further comprises a screw jack and a rod with a support plate mounted thereon received at a lower end thereof so as to enable vertical adjustment of each interior column; and a plurality of planks supported on the cross bars of the end frames of the exterior framework, each plank of the plurality of planks extending between adjacent end frame columns of the exterior framework and bounded between the interior columns of the interior framework to define a walkway of a sufficient size to support and enable movement and access of workers to the elevated structure;

wherein the exterior and interior framework are configured to be arranged in non-planar configurations about the structure so as to substantially match a configuration of the structure.

2. The scaffold system of claim 1, further comprising a flexible material applied to the exterior framework opposite the elevated structure to form a containment barrier that substantially surrounds the exterior framework.

3. The scaffold system of claim 2, wherein the walkway has a width less than a width of the end frames sufficient to contain the walkway within a volume circumscribed by the exterior framework and each end of the planks of the walkway is substantially within the volume circumscribed by the exterior framework so as to minimize engagement of the flexible material of the containment barrier by the ends of the planks, without substantially restricting movement and access to the structure by the workers.

4. The scaffold system of claim 1, wherein the interior framework is substantially self-supporting.

5. The scaffold system of claim 1, further comprising swivel clamps configured to couple the posts of the interior columns to the cross bars of the end frames.

6. The scaffold system of claim 1, wherein the interior columns are adjustable with respect to a ground surface and operate to maintain, spread, or reduce loads exerted on the end frame columns.

7. The scaffold system of claim 1, wherein a distance along the cross bar between uprights is approximately equal to the width of five planks and a distance between the interior columns is approximately equal to the width of two planks.

8. The scaffold system of claim 1, wherein the series of side rails comprises a mid rail and a top rail arranged on both sides of the walkway, and wherein the top rail is secured to one or more posts at a first distance from a bottom portion of the posts and the mid rail is secured to one or more posts at a second distance from the bottom portion of the posts.

9. The scaffold system of claim 1, wherein the series of side rails are coupled to the posts with D-locks mounted at various elevations along the posts and comprising pivoting latches configured to engage a latch opening defined in an end of one or more of the side rails.

10. The scaffold system of claim 1, wherein the series of side rails comprise telescoping rails comprising a first rail slideably received within a second rail such that a length of each side rail is adjustable.

11. The scaffold system of claim 10, wherein each first rail comprises latch openings configured to be connectible to rail attachment mechanisms secured to the pairs of posts.

* * * * *